US005969310A

United States Patent [19]

Schwelling

[11] Patent Number: 5,969,310

[45] Date of Patent: Oct. 19, 1999

[54] SWITCHING FLAP FOR STOPPING THE DRIVE OF CUTTING MECHANISMS FOR PAPER SHREDDERS AND SIMILAR DEVICES

[76] Inventor: Hermann Schwelling, Hartmannweg 5, D-88682 Salem, Germany

[21] Appl. No.: 08/949,087

[22] Filed: Oct. 10, 1997

[30] Foreign Application Priority Data

Oct. 11, 1996 [DE] Germany ..... 196 41 934

[51] Int. Cl.[6] ..... H01H 3/16

[52] U.S. Cl. ..... 200/61.41; 200/343

[58] Field of Search ..... 200/61.1, 61.09, 200/61.41, 61.58 R, 61.59, 343; 241/36

[56] References Cited

U.S. PATENT DOCUMENTS 3,632,918 1/1972 Anson et al. ..... 200/61.41
3,867,591 2/1975 Nordeen ..... 200/61.58 R
4,613,736 9/1986 Shichijo et al. ..... 200/343 X
5,167,374 12/1992 Strohmeyer ..... 241/36

*Primary Examiner*—Renee S. Luebke
*Attorney, Agent, or Firm*—Friedrich Kueffner

[57] ABSTRACT

A switching flap for stopping the drive of cutting mechanisms of paper shredders or similar devices, wherein the respective cutting mechanism is accommodated in a housing placeable on a collecting container for cut material and the switching flap is arranged at the bottom side of the housing in an area laterally of the outlet gap for the cut material. The switching flap is inserted at connecting points into the bottom part of the housing. Immediately above the connecting points, the switching flap has a resilient joint which extends over the entire length of the switching flap. On its side facing away from the outlet gap for the cut material, the switching flap has a rib or the like serving as a switching cam for actuating the limit switch resulting in the stoppage of the drive.

4 Claims, 2 Drawing Sheets

SWITCHING FLAP FOR STOPPING THE DRIVE OF CUTTING MECHANISMS FOR PAPER SHREDDERS AND SIMILAR DEVICES

BACKGROUND OF THE INVENTION

1. Field of the Invention

The present invention relates to a switching flap for stopping the drive of cutting mechanisms of paper shredders or similar devices, wherein the respective cutting mechanism is accommodated in a housing placeable on a collecting container for cut material and the switching flap is arranged at the bottom side of the housing in an area laterally of the outlet gap for the cut material.

2. Description of the Related Art

Switching flaps integrated at the bottom side of a cutting mechanism housing for the purpose of stopping the drive when the collecting container for the cut material is full are known in the art and have in the past been constructed in such a way that their movements are transmitted through more or less complicated lever and linkage parts including corresponding bearings to a limit switch connected to the drive control.

The principal disadvantages of these known embodiments are primarily the substantial structural requirements with respect to manufacture and assembly together with a relatively high susceptibility to trouble because of the presence of rods, levers, etc.

SUMMARY OF THE INVENTION

Therefore, it is the primary object of the present invention to provide a switching flap of the above-described type which is extremely simple with respect to construction and assembly, requires practically no bearings and is absolutely not susceptible to trouble and, thus, operates safely and reliably.

In accordance with the present invention, the switching flap is inserted at connecting points into the bottom part of the housing. Immediately above the connecting points, the switching flap has a resilient joint which extends over the entire length of the switching flap. On its side facing away from the outlet gap for the cut material, the switching flap has a rib or the like serving as a switching cam for actuating the limit switch resulting in the stoppage of the drive.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE PREFERRED EMBODIMENTS

Figure 2:
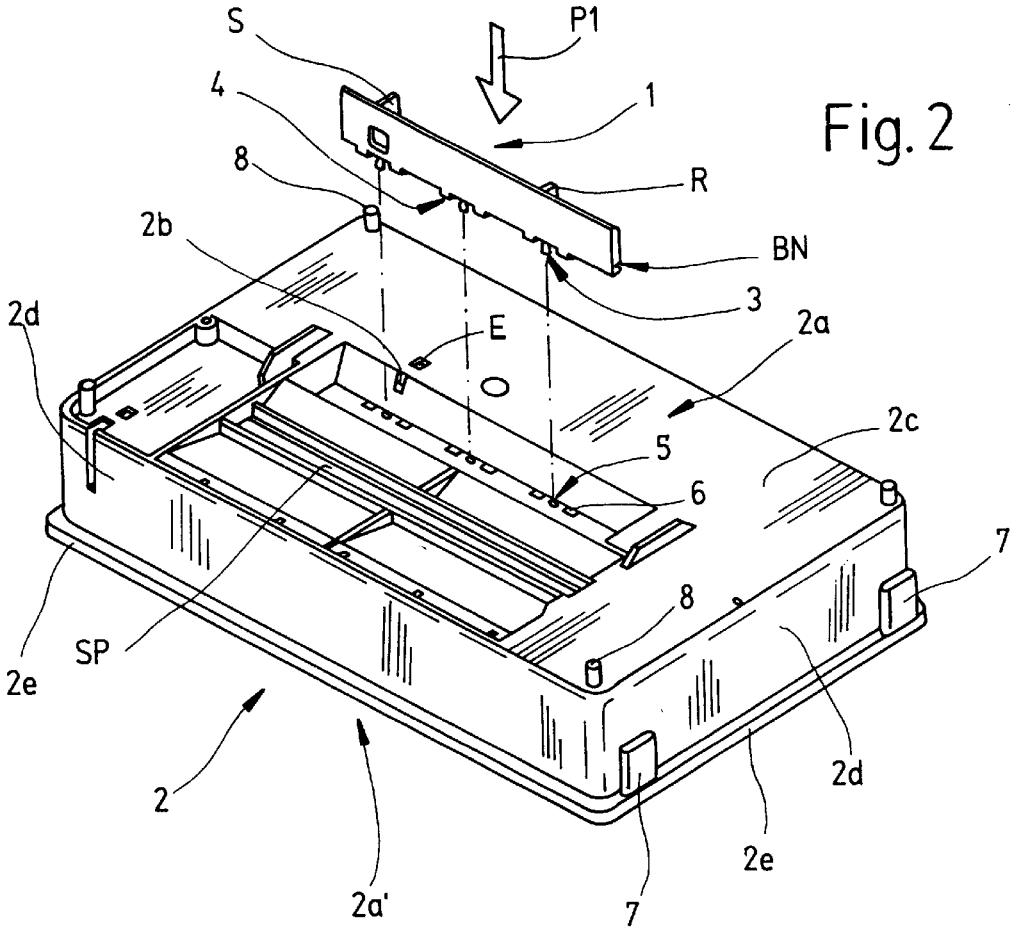
FIG. 2 is the same perspective view as FIG. 1, except that the switching flap has not yet been inserted.
Figure 1:
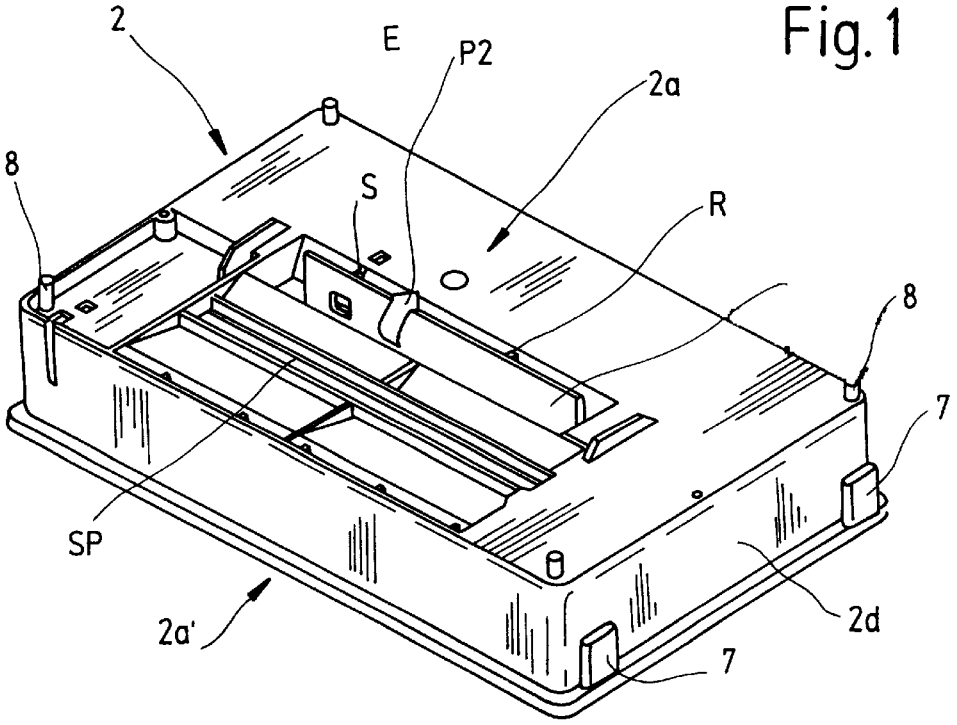
FIG. 1 is a perspective bottom view of the cutting mechanism housing of a paper shredder provided with the switching flap according to the present invention.
Figure 3:
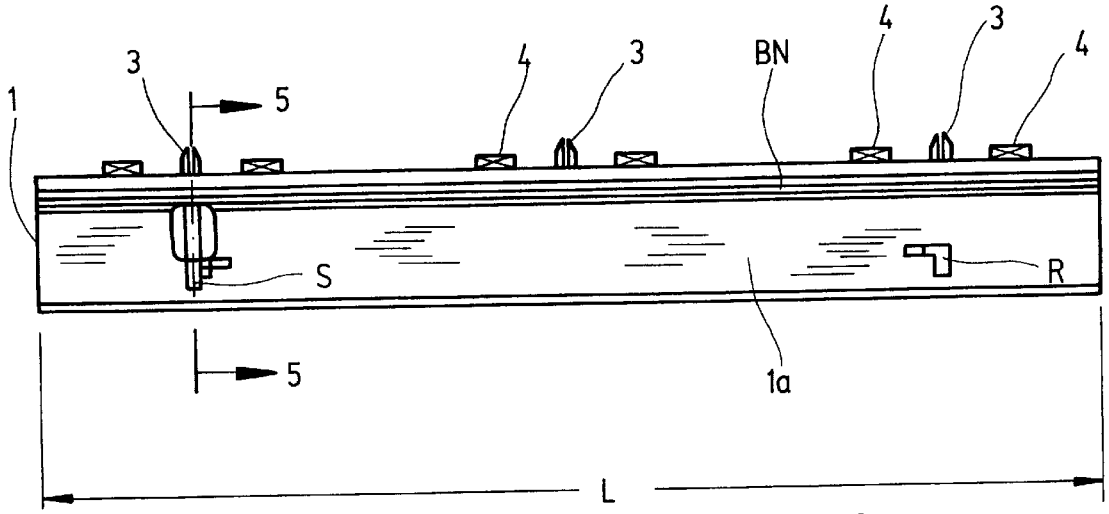
FIG. 3 is an elevational view, on a larger scale, of the switching flap of FIG. 1.
Figure 4:
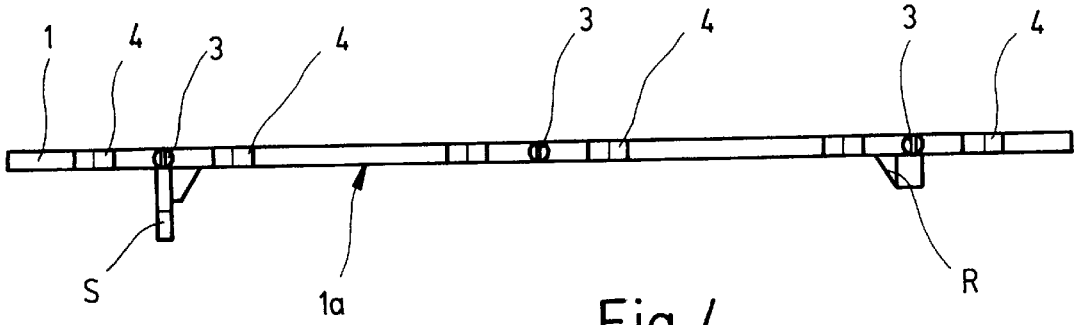
FIG. 4 is a top view of the switching flap of FIG. 3.
Figure 5:
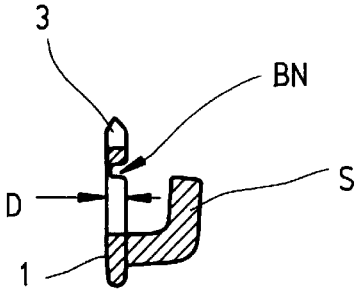
FIG. 5 is a sectional view taken along sectional line 5—5 of FIG. 3.

FIGS. 1 and 2 of the drawing show the basic configuration of a moveable switching flap 1 according to the present invention which acts on the motor limit switch E and is arranged on the bottom part 2*a* of a cutting mechanism housing 2 laterally next to the outlet gap SP for the cut material.

In accordance with the present invention, the switching flap 1 is inserted through appropriate connecting points 3,4 and 5,6 into the bottom part 2*a* of the housing. Immediately above the connecting points 3,4 and 5,6, the switching flap 1 has a resilient joint BN which extends over the entire L of the switching flap 1. On the side 1*a* facing away from the outlet gap SP for the cut material, the switching flap 1 has a rib S or the like which serves as a switching cam for actuating the limit switch E which causes stoppage of the drive.

In accordance with a special further structural development, the connecting points are in the form of frictionally engaging snap-type connections 3 and positively engaging guide pins 4 at the lower edge of the switching flap 1, wherein the bottom part 2*a* of the housing has corresponding recesses 5 and 6 and the resilient joint provided immediately above the connecting points 3,4 and 5,6 extending parallel to the bottom part 2*a* of the housing is configured as a so-called bending groove BN in the material thickness D. Consequently, the restoring force of the switching flap 1 is produced by the elasticity and geometry of the respective material used for the switching flap, so that the switching flap according to the present invention does not require additional restoring elements nor bearings or shifting levers including transmission linkages which are susceptible to trouble.

In accordance with another advantageous further structural development, the switching cam S acts through a recess 2*b* provided at the bottom part 2*a* of the housing on the limit switch E and the movement of the switching flap 1 in the direction toward the limit switch E is limited by another rib R which rests against the upper surface 2*c* of the bottom 2*a* of the housing in the end position thereof; this means that unnecessary pressure on the limit switch E and its fastening elements does not occur.

In accordance with another useful feature of the switching flap according to the present invention, the switching cam S and the limiting rib R are located on the same side 1*a* of the switching flap and above the bending groove BN; this makes it possible to construct the switching flap 1 including bending groove BN, switching cam S, rib R and insertable connecting points 3 and 4 in an economical and, thus, inexpensive manner as a single-piece shaped part of synthetic material without requiring further mechanical processing.

Also shown in the drawing are centering pins 7 and 8 at the housing sides 2*d* which, together with the housing flange 2*e* serve for securing the cutting mechanism housing 2 on an appropriately constructed collecting container for cut material which is not shown in the drawing.

The invention is not limited by the embodiments described above which are presented as examples only but can be modified in various ways within the scope of protection defined by the appended patent claims.

I claim:

1. A switching flap in combination with a paper shredder cutting mechanism for stopping a drive of the cutting mechanism, wherein the cutting mechanism is accommodated in a housing adapted to be placeable onto a collecting container for cut material, and wherein the switching flap is mounted at a bottom part of the housing in an area laterally of an outlet gap for the cut material, the switching flap comprising connecting means for inserting the switching flap into the lower part of the housing, the switching flag further comprising immediately above the connecting means a resilient joint extending over an entire length of the switching flap, wherein the switching flap has a rib on a side facing away from the outlet gap serving as a switching cam for actuating a limit switch serving to stop the drive, wherein the connecting means comprise frictionally engaging snap-type connections and positively engaging guide pins provided at a bottom edge of the switching flap, the bottom of the housing having recesses for receiving the snap-type connections and guide pins, wherein the resilient joint extending above the connecting means parallel to the bottom part of the housing is comprised of a bending groove formed in a material thickness of the switching flap.

2. The switching flap according to claim 1, wherein the bottom part of the housing has a recess through which the switching cam acts on the limit switch, the switching flap further comprising another rib mounted so as to rest against an upper surface of the bottom of the housing in an end position thereof for limiting movement of the switching flap toward the limit switch.

3. The switching flap according to claim 2, wherein the switching cam and the another rib are located on the same side of the upper surface of the switching flap and above the bending groove.

4. The switching flap according to claim 3, wherein the switching flap including bending groove, switching cam, another rib and connecting points are comprised of a single-piece shaped part of synthetic material without further mechanical processing.

* * * * *